United States Patent [19]

Prouty

[11] Patent Number: 4,833,964

[45] Date of Patent: May 30, 1989

[54] OPEN-SIDED MUSICAL DRUM

[76] Inventor: Deane L. Prouty, 5535 Netherland Ave., Riverdale, N.Y. 10471

[21] Appl. No.: 113,032

[22] Filed: Oct. 26, 1987

[51] Int. Cl.[4] ..... G10D 13/02

[52] U.S. Cl. ..... 84/411 R; 84/413

[58] Field of Search ..... 84/411 R, 413, 415

[56] References Cited

U.S. PATENT DOCUMENTS

| | | | |
|---|---|---|---|
| 3,981,220 | 9/1976 | Clark | 84/415 |
| 4,448,105 | 5/1984 | Cordes | 84/413 |
| 4,520,709 | 6/1985 | Kester | 84/411 R |
| 4,660,455 | 4/1987 | Jones et al. | 84/411 R |
| 4,714,002 | 12/1987 | Cleland | 84/413 |

FOREIGN PATENT DOCUMENTS

| | | | |
|---|---|---|---|
| 1657 | 6/1862 | United Kingdom | 84/411 R |
| 2033131 | 5/1980 | United Kingdom | 84/413 |

*Primary Examiner*—Lawrence R. Franklin
*Attorney, Agent, or Firm*—Rohm & Monsanto

[57] ABSTRACT

A drum of the type having first and second drum heads on opposite ends thereof is provided with first and second bearing hoops, each such bearing hoop being associated with a respective one of the first and second drum heads. Each bearing hoop is provided with an annular bearing ring member which communicates with a respectively associated one of the drum heads, and a bearing hoop coupling means, which is affixed to the annular bearing ring member, and has a plurality of through-holes therein. The drum is further provided with first and second counter hoops, each such counter hoop being associated with a respective one of the drum heads, and provided with an annular counter hoop ring member having an annular bearing edge for communicating with an outward side of the annular drum head ring of its associated drum head. Counter hoop coupling means are affixed to the annular counter hoop ring member and are also provided with a plurality of through-holes therein. The drum head assemblies are coupled to one another by a plurality of spacer members which define the distance between the drum head assemblies and provide acoustic coupling therebetween. The drum head assemblies are coupled to the respective ends of the spacer members by fasteners, which additionally serve as tuning members for the drum heads.

7 Claims, 1 Drawing Sheet

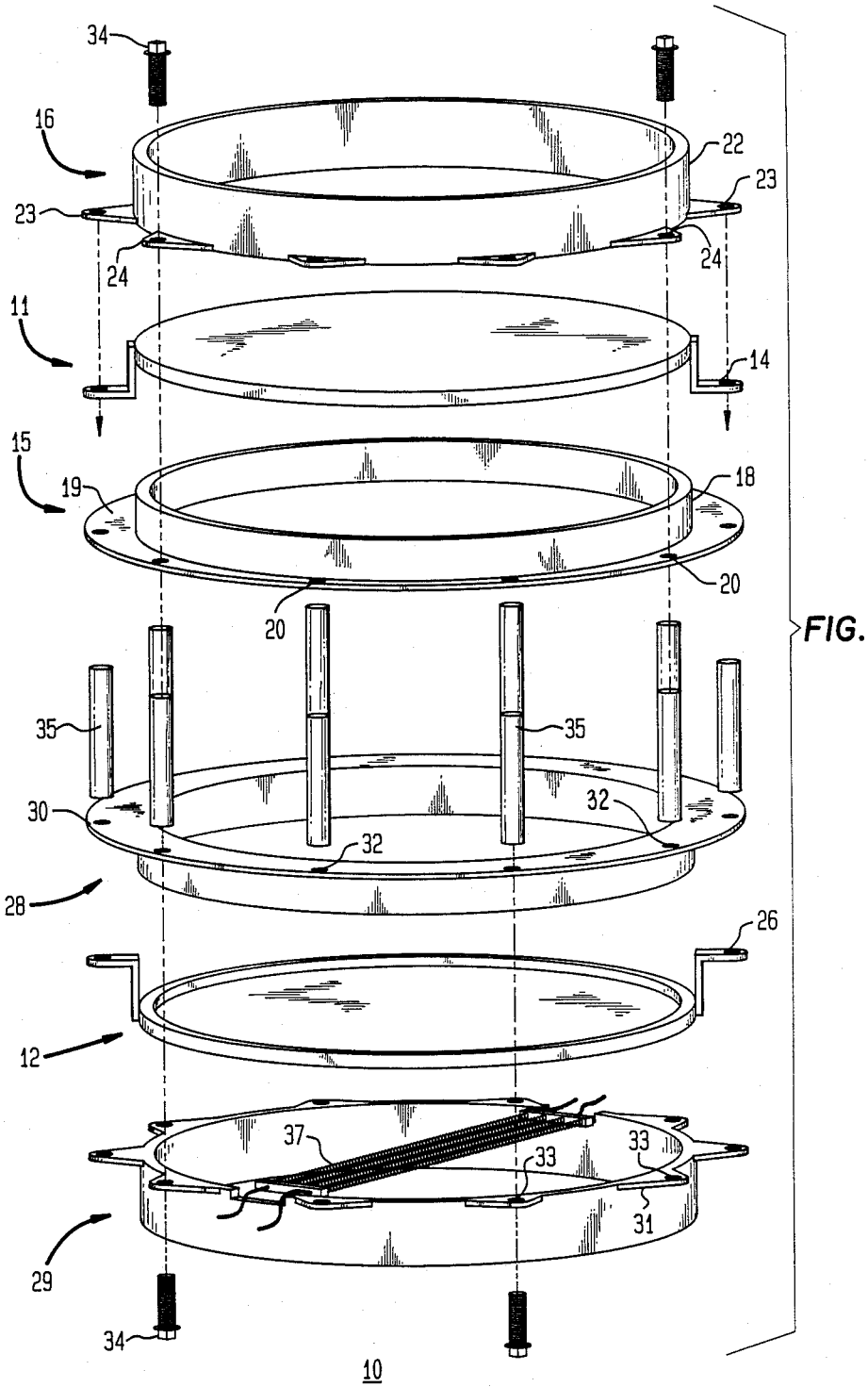
FIG.

OPEN-SIDED MUSICAL DRUM

BACKGROUND OF THE INVENTION

This invention relates generally to percussion instruments for use in the making of music, and more particularly, to a drum, such as a snare drum, which has improved acoustic properties and which does not employ a drum shell.

A large number of drum arrangements, particularly snare drum arrangements, are known and are in common use. Typically, drums of the known type utilize a cylindrical drum shell having somewhat rounded edges on both ends thereof. Drum heads are installed on respective ends of the drum shell, as well as respective counter hoops which communicate with the associated drum heads on the opposite sides from the drum shell. In most known arrangements, the counter hoops are urged, by operation of threaded members, toward the drum shell, thereby causing an increase in the tension forces operating on the drum heads.

The typical drum shell extends from head to head, thereby containing therewithin a column of air. Upon striking one of the drum heads, a vibration is propagated along the column, which impinges upon the opposite drum head. In this manner, the drum heads are acoustically coupled to one another. Thus, if a snare arrangement is installed on the opposite drum head, the responsive vibration of the opposite drum head will cause the snare to make its characteristic sound.

It is desirable to provide a two-head drum arrangement, such as a snare drum, which does not use a conventional drum shell, as such a drum would have certain acoustic characteristics which are desirable, and different from conventional snare drums. However, the absence of the drum shell would reduce the aforementioned acoustic coupling between the drum heads and result in a reduction in the effectiveness of the snare.

It is, therefore, an object of this invention to provide a simple and inexpensive drum arrangement which does not employ a supporting drum shell.

It is also an object of this invention to provide a snare drum arrangement having improved acoustic characteristics over conventional snare drum systems.

It is another object of this invention to provide a snare drum which utilizes two heads, a batter head and a snare head, wherein the heads are firmly fixed in predetermined space relation to one another without a shell member interposed therebetween.

It is further object of this invention to provide a drum system wherein two spaced apart drum heads are adjustable in tension independently of one another.

It is additionally an object of this invention to provide a drum arrangement wherein first and second drum heads are spaced apart from one another, but coupled mechanically and acoustically to one another.

It is yet a further object of this invention to provide a drum arrangement wherein a contained column of air is not required to effect an acoustic coupling between the drum heads.

SUMMARY OF THE INVENTION

The foregoing and other objects are achieved by this invention which provides a drum of the type having first and second drum heads each having a substantially planar circular drum head web with inward and outward sides and surrounded by an annular drum head ring. The drum heads are arranged in substantially axial and parallel spaced apart orientation with their respective inward sides facing one another. Each of the drum heads has associated therewith a bearing hoop, and an annular bearing ring member having an annular bearing edge for communicating with the inward side of the circular web of an associated one of the drum heads. Bearing hoop coupling means, illustratively in the form of at least one flange portion, is affixed to the annular bearing ring member. A plurality of through-holes are provided therein to facilitate coupling.

Further in accordance with the invention, each of the drum heads has associated therewith a counter hoop having an annular counter hoop ring member having an annular bearing edge for communicating with an outward side of the annular drum head ring of its associated one of the drum heads. At least one counter hoop coupling member is affixed to the annular counter hoop ring member and is provided with a plurality of through-holes. Additionally, a plurality of spacer members are provided for defining a predetermined distance between registering ones of the through-holes of the coupling means of the first and second bearing hoop coupling means. A plurality of fastener members are provided for fastening to one of said spacer members, the bearing hoop coupling means and the counter hoop coupling means. Each of the fasteners is associated with one of the drum heads.

In a specific illustrative embodiment of the invention, there is provided a snare arranged to communicate with the second drum head. Control over the application of the snare to a head of the drum, preferably the bottom drum head, is achieved in a conventional manner.

The present invention provides a drum system wherein highly advantageous tonal characteristics, including increased output volume over conventional drum systems and acoustic cooperation between the drum heads, are achieved. Moreover, this is achieved without the need of a contained volume within a drum shell for achieving acoustic coupling between the drum heads using the conventional air column within a drum shell. To an extent, the acoustic vibrations of the batter head of the drum, when it is struck, are propagated through a plurality of rigid spacer members to a bottom head, which may have the snare coupled thereto.

In certain embodiments, the spacer members are formed of lengths of internally threaded tubing. In such an embodiment, the fastener members may be screws which are threaded to engage with the internally threaded tubing.

In accordance with a further aspect of the invention, a pair of drum head assemblies, are each provided with a drum head interposed between a bearing ring member arranged on a first side of the drum head and a counter hoop member arranged on a second side of the drum head. Each of the bearing ring and counter hoop members have respectively associated flange portions with apertures arranged therethrough. The apertures, or holes, in the flange portions associated with the bearing ring and counter hoop members are arranged to be in registration with each other.

In a manner similar to that described hereinabove, a plurality of spacer members are interposed axially between the first and second drum head assemblies, and arranged to register with respectively associated ones of the apertures of the flange portions of the first and second drum head assemblies.

A plurality of fastener members are each provided for engaging with an associated one of the spacer members. The bearing ring and counter hoop members associated with respective ones of the drum head assemblies are urged toward one another upon tightening of the fastening members. Such fastening members therefore additionally operate as tuning means for the drum heads.

The spacer members each have first and second ends for applying a force against the flange portions associated with the bearing ring members of the first and second drum head assemblies, respectively. The fastener members are arranged to apply force against the flange portions associated with the counter hoop members.

In a further specific illustrative embodiment, each of the spacer members is provided with a shoulder for urging against said flange portions associated with the bearing ring members and an externally threaded rod portion extending beyond the shoulder of the spacer member and through registering ones of the flange portions associated with the bearing ring and counter hoop members. In such an embodiment of the invention, the fastener members are each provided with an internally threaded portion for engaging threadedly with the externally threaded rod portion of an associated spacer member.

BRIEF DESCRIPTION OF THE DRAWING

Comprehension of the invention is facilitated by reading the following detailed description, in conjunction with the annexed drawing, which is an exploded isometric representation of a drum constructed in accordance with the principles of the invention.

DETAILED DESCRIPTION

The drum arrangement shown in the FIGURE is depicted in exploded representation to facilitate comprehension of the manner in which the various parts of the drum relate with one another. As shown, a drum arrangement 10 is formed essentially of a first drum head assembly 11 and a second drum head assembly 12.

Drum head assembly 11 is provided with a drum head 14 which is interposed between a bearing ring 15 and a counter hoop 16. In this specific illustrative embodiment of the invention, bearing ring 15 is formed of an annular bearing member 18 and an annular coupling portion 19. Annular bearing member 18 and annular coupling portion 19 are coupled to one another, annular coupling portion 19 being provided with a plurality of apertures 20.

Counter hoop 16 is formed of an annular hoop portion 22 having coupled thereto in this embodiment a plurality of coupling portions 23. Each of the coupling portions 23 has, in this embodiment, an aperture 24 therethrough. As shown, apertures 20 and apertures 24 are arranged to register axially with one another.

Drum head assembly 12 is similar to drum head assembly 11, and is provided with a drum head 26 interposed between a bearing ring 28 and a counter hoop 29. As described hereinabove with respect to bearing ring 15 and counter hoop 16, bearing ring 28 and counter hoop 29 are each provided with respective coupling portions 30 and 31, and with respective apertures 32 and 33. Also as described hereinabove, apertures 32 and apertures 33 are in axial registration with each other. Such registration permits passage therethrough of screw members 34.

In this embodiment, screw members 34 engage threadedly with respective ends of respectively associated ones of internally threaded tubing members 35. Upon actuation, or tightening, of screw members 34, engagement is made with internally threaded tubing members 35 such that the counter hoops are urged forcefully into communication with the drum heads, which subsequently are driven into forceful communication with the bearing rings. The internally threaded tubing members communicate at their respective ends with the bearing rings, and the heads of screw members 34 communicate with the respectively associated counter hoops.

The embodiment of the invention shown in the FIGURE is provided with snares 37. The snares can be controlled in a conventional manner, the details of which are not shown in the drawing.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A drum of the type having first and second drum heads each having a substantially planar circular drum head web with inward and outward sides and surrounded by an annular drum head ring, the drum heads being arranged in substantially axial and parallel spaced apart orientation with their respective inward sides facing one another, the drum comprising:

first and second bearing hoop means, each such bearing hoop means being associated with a respective one of the first and second drum heads, and having an annular bearing ring member having an annular bearing edge for communicating with the inward side of the circular web of said associated one of the drum heads, and bearing hoop coupling means affixed to said annular bearing ring member having a plurality of through-holes therein;

first and second counter hoop means, each such counter hoop means being associated with a respective one of the first and second drum heads, having an annular counter hoop ring member having an annular bearing edge for communicating with an outward side of the annular drum head ring of said associated one of the drum heads, and counter hoop coupling means affixed to said annular counter hoop ring member having a plurality of through-holes therein;

a plurality of spacer members for defining a predetermined distance between first and second ends thereof, there being provided threaded means at each of said respective ends arranged to align with registering ones of said through-holes of said coupling means of said first and second bearing hoop coupling means; and a plurality of threaded fastener members, each for coupling to a respective one of said threaded means of an associated one of said spacer members, and for fastening thereto said bearing hoop coupling means and said counter hoop coupling means, each associated with a one of the drum heads, said bearing hoop coupling means being interposed between said counter hoop coupling means and said respective spacer member, said counter hoop coupling means and said bearing hoop coupling means being urged toward one another upon actuation of said fastening members, the associated drum head web being subjected to a tensile force which increases as said bearing hoop coupling means and said counter hoop coupling means are urged toward one another.

2. The drum of claim 1 wherein there is further provided snare means arranged to communicate with the second drum head.

3. The drum of claim 1 wherein said spacer members comprise lengths of internally threaded tubing.

4. The drum of claim 3 wherein said fastener members comprise screws which are threaded to engage with said internally threaded tubing.

5. A drum comprising:

a pair of drum head assemblies, each being provided with a drum head interposed between a bearing ring member arranged on a first side of said drum head and a counter hoop member arranged on a second side of said drum head, each of said bearing ring and counter hoop members having respectively associated flange portions with apertures arranged therethrough, said apertures in said flange portions associated with said bearing ring and counter hoop members being in registration with each other;

a plurality of spacer members interposed axially between said first and second drum head assemblies and arranged to register with respectively associated ones of said apertures of said flange portions of said first and second drum head assemblies, each of said spacer members being provided with an internally threaded portion, said flange portion of said bearing ring member being interposed between said plurality of spacer hoop members and said flange portion of its associated counter hoop member; and a plurality of fastener members each consisting of screws threaded to engage threadedly with said internal threads of an associated one of said spacer members, said flange portions of said bearing ring and counter hoop members associated with respective ones of said drum head assemblies being urged toward one another upon tightening of said fastening members.

6. The drum of claim 5 wherein said fastener members are arranged to apply a force against said flange portions associated with said counter hoop members.

7. The drum of claim 5 wherein said spacer members have first and second ends for applying a force against said flange portions associated with said bearing ring members of said first and second drum head assemblies, respectively.

* * * * *